US007914198B2

(12) United States Patent
Mier-Langner et al.

(10) Patent No.: US 7,914,198 B2
(45) **Date of Patent: *Mar. 29, 2011**

(54) MODULAR LUMINAIRE SYSTEM

(75) Inventors: Alejandro Mier-Langner, Providence, RI (US); James E. Kuchar, Fall River, MA (US); Andrew E. Medeiros, Fall River, MA (US)

(73) Assignee: Gentyle Thomas Group LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/411,980

(22) Filed: Mar. 26, 2009

(65) Prior Publication Data

US 2009/0180301 A1 Jul. 16, 2009

Related U.S. Application Data

(62) Division of application No. 11/122,596, filed on May 5, 2005, now Pat. No. 7,513,675.

(60) Provisional application No. 60/568,831, filed on May 6, 2004.

(51) Int. Cl.
*F21V 21/34* (2006.01)

(52) U.S. Cl. ..... 362/648; 362/147; 362/404; 439/121; 361/674

(58) Field of Classification Search ..... 362/147, 362/220, 221, 404, 406, 407, 647, 648; 439/110, 439/115, 121; 361/674
See application file for complete search history.

(56) References Cited

U.S. PATENT DOCUMENTS

| | | | | |
|---|---|---|---|---|
| 1,301,994 | A | | 4/1919 | Archer et al . |
| 1,666,411 | A | | 4/1928 | D'Olier, Jr. |
| 1,879,600 | A | | 9/1932 | Burchett |
| 1,885,513 | A | | 11/1932 | De Mask |
| 1,977,883 | A | | 10/1934 | Levy |
| 2,026,884 | A | | 1/1936 | Glasgow |
| 2,108,052 | A | | 2/1938 | Eitzen |
| 2,614,457 | A | | 10/1952 | Weber |
| 2,856,592 | A | | 10/1958 | Carlson |
| 3,180,981 | A | | 4/1965 | Ulffers |
| 3,298,277 | A | | 1/1967 | Scharf |
| 3,529,275 | A | | 9/1970 | Routh |
| 3,562,616 | A | | 2/1971 | Elliott |
| 3,718,816 | A | | 2/1973 | Seelbach et al. |
| 3,737,761 | A | | 6/1973 | Walther |
| 3,896,355 | A | | 7/1975 | Guicheteau |
| 3,940,634 | A | | 2/1976 | Grogan |
| 3,959,644 | A | | 5/1976 | Dammel et al. |
| 4,007,378 | A | | 2/1977 | Lazzara |
| 4,052,625 | A | | 10/1977 | Cameron |
| 4,118,658 | A | | 10/1978 | Salva et al. |
| 4,250,437 | A | | 2/1981 | Morton et al. |
| 4,352,993 | A | | 10/1982 | Hannas |
| 4,533,190 | A | | 8/1985 | Booty |
| 4,584,506 | A | | 4/1986 | Kaszmann |
| 4,655,520 | A | * | 4/1987 | Cummings ..... 439/111 |
| 4,670,699 | A | | 6/1987 | Yang |
| 4,676,567 | A | | 6/1987 | Mouchi |
| 4,701,833 | A | | 10/1987 | Bornhorst |
| 4,729,074 | A | | 3/1988 | Steadman |
| 4,748,532 | A | | 5/1988 | Commander et al. |

(Continued)

*Primary Examiner* — Laura Tso

(57) ABSTRACT

The modular track luminaire system of the present invention is a modular lighting system which has a lighting unit which is electronically connected to a remote ballast housing by a removable and reattachable insulated cord and plug system, the luminaire unit electrically connected to the ballast housing through the flexible cord and plug system thereby allowing the entire system to be modularized.

7 Claims, 20 Drawing Sheets

U.S. PATENT DOCUMENTS

| | | | | |
|---|---|---|---|---|
| 4,861,273 | A | 8/1989 | Wenman et al. | |
| 4,992,709 | A | 2/1991 | Griffin | |
| 5,128,847 | A * | 7/1992 | Lin et al. | 362/648 |
| 5,191,501 | A | 3/1993 | Blau | |
| 5,803,755 | A | 9/1998 | Kuchar et al. | |
| 5,921,655 | A | 7/1999 | Nassim | |
| 6,004,005 | A | 12/1999 | Demshki | |
| 6,033,097 | A * | 3/2000 | Harwood | 362/404 |
| 6,217,189 | B1 | 4/2001 | Nassim | |
| 6,273,587 | B1 | 8/2001 | Demshki | |
| 6,474,846 | B1 | 11/2002 | Kelmelis et al. | |
| 6,612,076 | B2 | 9/2003 | Jacksen | |
| 6,843,581 | B2 | 1/2005 | Mier-Langner et al. | |
| 6,997,574 | B2 | 2/2006 | Kotovsky | |
| 7,175,300 | B1 | 2/2007 | Medeiros | |
| 7,513,675 | B2 * | 4/2009 | Mier-Langner et al. | 362/648 |
| 2002/0137374 | A1 | 9/2002 | O'Rourke | |
| 2003/0137835 | A1 * | 7/2003 | Mier-Langner et al. | 362/220 |
| 2005/0152132 | A1 * | 7/2005 | Bernhart et al. | 362/147 |
| 2007/0115694 | A1 * | 5/2007 | Mobarak et al. | 362/648 |

* cited by examiner

MODULAR LUMINAIRE SYSTEM

CROSS REFERENCE TO RELATED APPLICATION

This divisional application claims benefit under 35 USC 120 of U.S. application Ser. No. 11/122,596, filed May 5, 2005, which will issue as U.S. Pat. No. 7,513,675 on Apr. 7, 2009, which application claims benefit under 35 USC 119(e) of U.S. Provisional Application No. 60/568,831, filed May 7, 2004, the entire disclosures of which are incorporated herein by reference.

TECHNICAL FIELD

The present invention is directed towards a modular luminaire system and in particular to a modular lighting system which has a luminaire unit, the luminaire unit electrically connected to a remote ballast housing by a removable and pluggable cord, the luminaire unit electrically connected to the ballast housing through this flexible cord and plug system.

REVIEW OF THE PRIOR ART

Luminaire systems of the prior art which require ballast electronics have typically had the ballast electronics integrated with the luminaire unit itself. With such a system, the ballast is hardwired to the luminaire directly thereby mandating that all ballast electronics be incorporated within the luminaire unit. Alternatively, the luminaire ballast electronics were typically combined into a single unit for placement or mounting along a ceiling or wall surface for later use. Commonly in such situations where ballast electronics are required, high intensity discharge lamps, metal-halide lamps and ceramic metal-halide lamps, to name a few, require ballast electronics for the requisite starting voltage as well as for continued electrical power. These prior art systems, however, have a significant drawback in that the luminaire unit must be combined with the ballast electronics thereby limiting the nature and aesthetic value of the prior art luminaires.

In these prior art systems, it was common to require the electronics for the ballast to be integrated within the electrical connections of the luminaire itself, therefore increasing the size of the luminaire as well as increasing the heat produced within the luminaire unit. In alternative constructions where the luminaires were combined with the ballast or ballast electronics, additional manufacturing steps were thus required and again, the aesthetic appearance of the luminaire was minimized due to the necessary size, which may be considerable, of the ballast electronics.

It is therefore desirable to have modular system wherein high intensity discharge lamps and the like, may be connected remotely to a ballast housing or ballast electronics thereby fully separating the luminaire unit and the ballast electronics in a fully modular system.

SUMMARY OF THE INVENTION

The present invention is directed towards a high intensity discharge modular lighting system which has a luminaire unit which is remotely and removably electrically connected to a remote ballast housing, the remote ballast housing being separate from the luminaire unit. The modular lighting system of the present invention utilizes a luminaire unit which has a cord and plug being insulated, the plug being received within a receptacle on the ballast housing. The ballast housing may be kept separate and remote from the luminaire unit thereby allowing the ballast electronics to be separated from the luminaire.

One of the benefits of the present invention is that the luminaire system may be a number of different illumination sources, such as high intensity discharge lamps, metal-halide or ceramic metal-halide while also allowing significantly different configurations to the luminaire and ballast combination. Thus, the luminaire unit may be designed such that it is not dependent upon the electronics of the ballast within the luminaire housing or directly affixed thereto.

Therefore, one object of the present invention is to provide a modular lighting system wherein the lighting system is comprised of a luminaire unit being electrically, but remotely connected by a cord and plug system to a remote ballast housing, the remote ballast housing providing the necessary starting pulse and power for various illumination lamps.

Another object of the present invention is to provide a modular lighting system wherein the luminaire is a high intensity discharge illumination luminaire connectable by a cord and plug system to a remotely positioned ballast unit, the remote ballast housing being one of a number of varying ballast electronics dependent upon the specific lamp or luminaire being utilized.

Another object of the present invention is utilization of a high intensity discharge modular illumination system having a separated remote ballast housing and a luminaire, the luminaire removably connected by a cord and plug system to the ballast, the ballast being configurable to and electrically connected with a track lighting system or alternative power source. The remote ballast unit may be removably attached to a track lighting system thereby contacting the electrical contacts on the track while providing the necessary electrical systems to a high intensity discharge illumination source on the luminaire unit.

One benefit of the present invention is that the remote placement of the ballast housing from the luminaire unit reduces the heat generated by the luminaire unit and also allows the luminaire unit, while being a high intensity discharge illumination source, from necessarily incorporating all of the ballast electronics within the luminaire.

The modular lighting system of the present invention provides a removable mounting mechanism allowing the luminaire unit to be attached to an unpowered track on the remote ballast housing or to an alternative mounting position. The remote ballast housing of the present invention may be electrically connected to a power track lighting system or may be a canopy mount or other various mounting positions. Such modularity between the luminaire unit and the remote ballast housing allows a number of configurations for high intensity discharge illumination while alternate placements of the remote ballast housing may be utilized, the two elements of the illumination system of the present invention being separated but electrically releasably connected by a removable cord and plug system allowing the luminaire to be plugged into the ballast housing.

The modular system of the present invention allows both the remote ballast housing and the luminaire unit to be removably attached or mounted in multiple positions while also making the luminaire unit aesthetically pleasing by removal of the ballast electronics from the luminaire.

These and other benefits of the present invention will be directly apparent after review of the drawings attached herewith along with the description and claim set forth herein.

DESCRIPTION OF THE PREFERRED EMBODIMENTS

Figure 1:
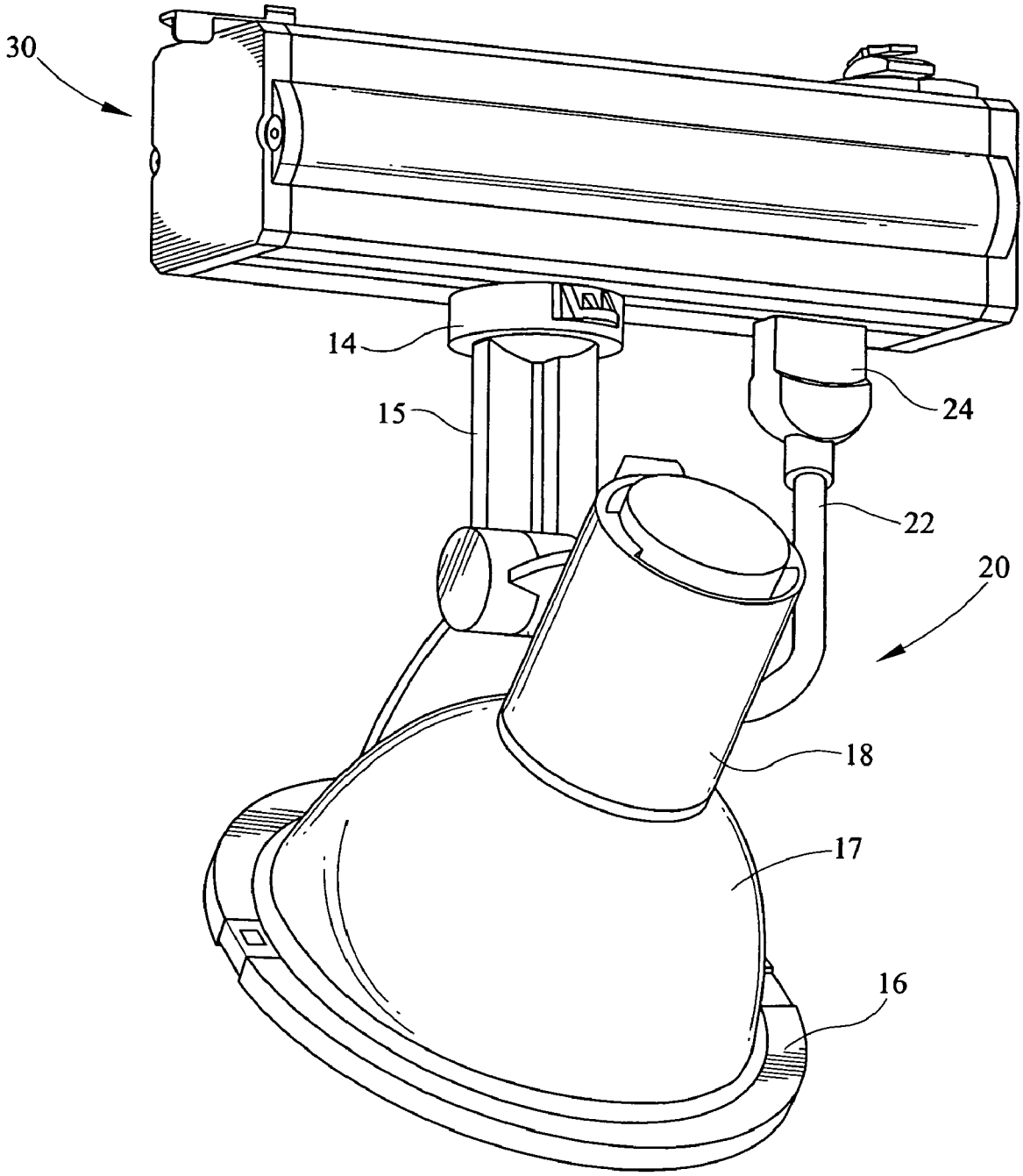
FIG. 1 is a perspective view of the modular lighting system of the present invention incorporating both the remote ballast housing and the luminaire unit electrically connected together.
Figure 2:
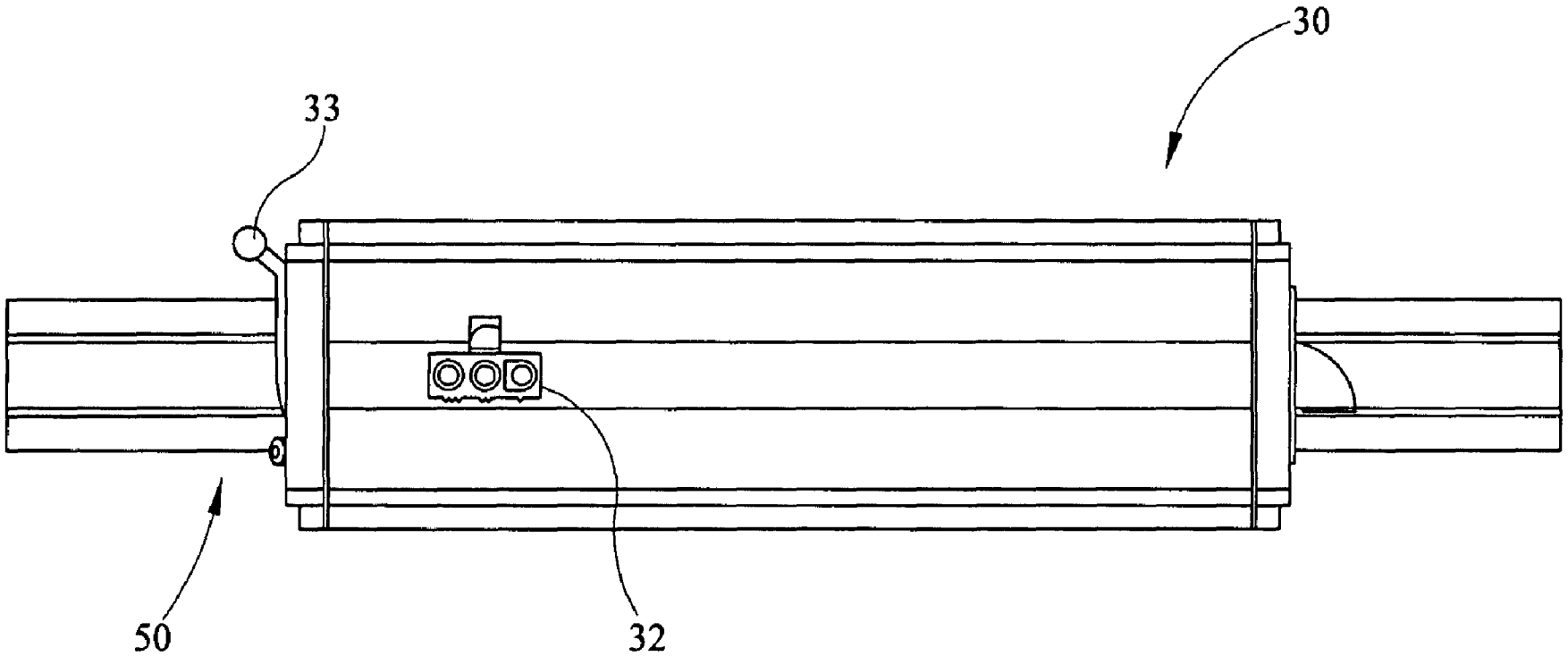
FIG. 2 is a bottom view of the remote ballast housing of the present invention.
Figure 3:
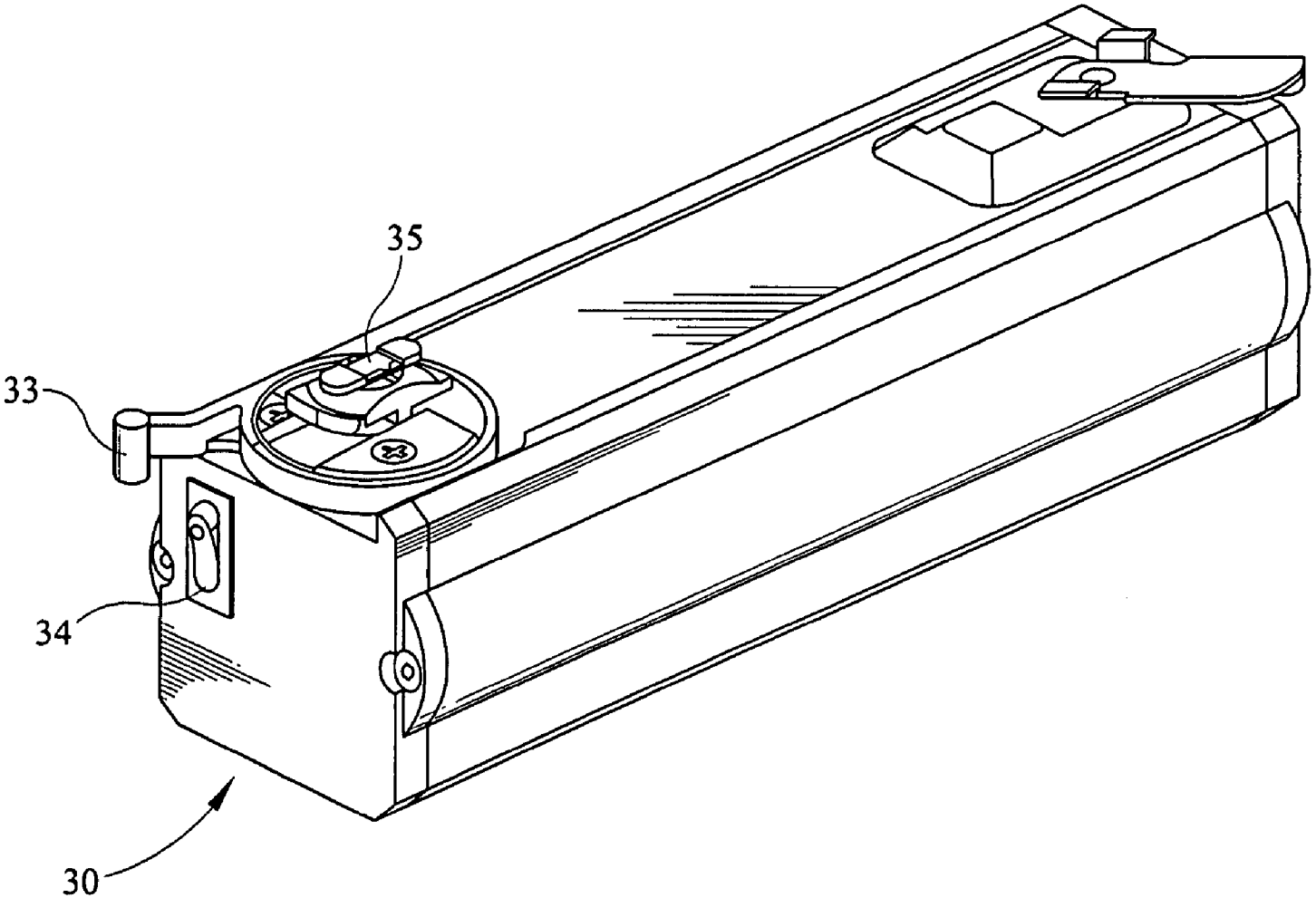
FIG. 3 is a top perspective view of the remote ballast housing of the present invention.

The modular lighting system of the present invention is shown in FIG. 1 wherein the remote ballast housing 30 is non-electrically connected to the luminaire unit 20 through the use of an attachment arm 15 and track attachment fitting 14. The luminaire unit 20 has a lamp socket cup 18, a reflector housing 17 and luminaire face 16 as depicted. The luminaire unit 20 of the present invention is electrically connected to the remote ballast housing 30 by the cord 22 and the plug 24 which is received within a receptacle of the remote ballast housing 30. By separating the remote ballast housing 30 and the luminaire unit 20 and allowing for a cord and plug electrical connection system, flexibility for high intensity discharge metal-halide track lighting is provided, among the various embodiments set forth herein. The modular lighting system of the present invention allows for flexibility in matching luminaire units with various remote ballast housings depending upon the particular illumination required and dependent upon the specific lamp utilized. Various aspects of the elements of the modular luminaire system of the present invention will be set forth herein.

The Luminaire Unit

The luminaire unit 20 depicted in FIG. 1 may be a number of different constructions and designs. High intensity discharge (HID), metal-halide and ceramic metal-halide lighting may be utilized with the remote ballast housings. The luminaire unit 20, as is shown in FIG. 1, is more clearly shown in FIG. 5, in one embodiment, as well as FIG. 13 and FIGS. 15, 16 and 17, depicting the various embodiments utilized with the modular luminaire system of the present invention.

Figure 5:
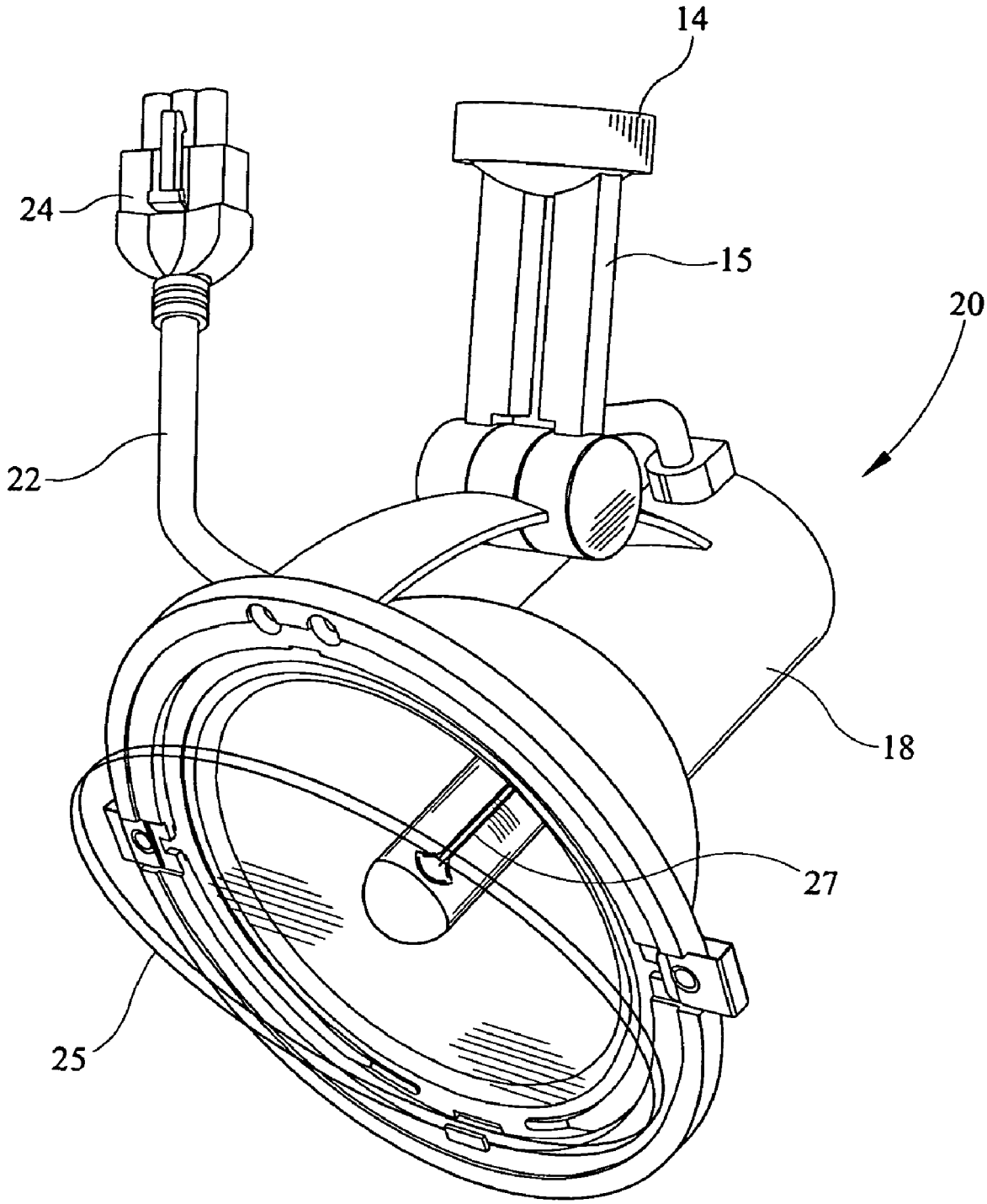
FIG. 5 is a close-up view of one embodiment of the luminaire unit of the present invention.
Figure 6:
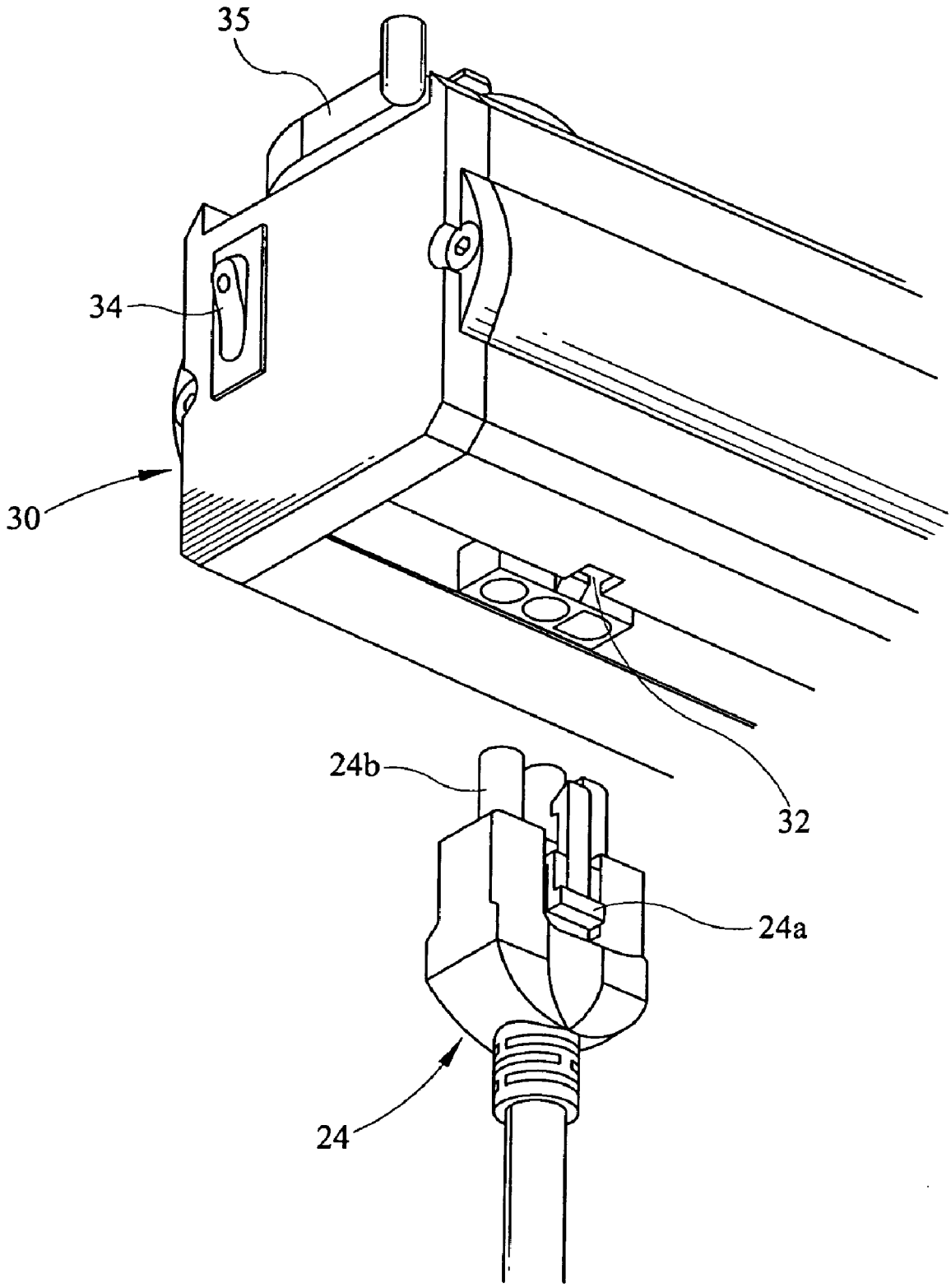
FIG. 6 is a close-up view of the cord and plug electrical connection between the luminaire unit and the remote ballast unit of the present invention.
Figure 7:
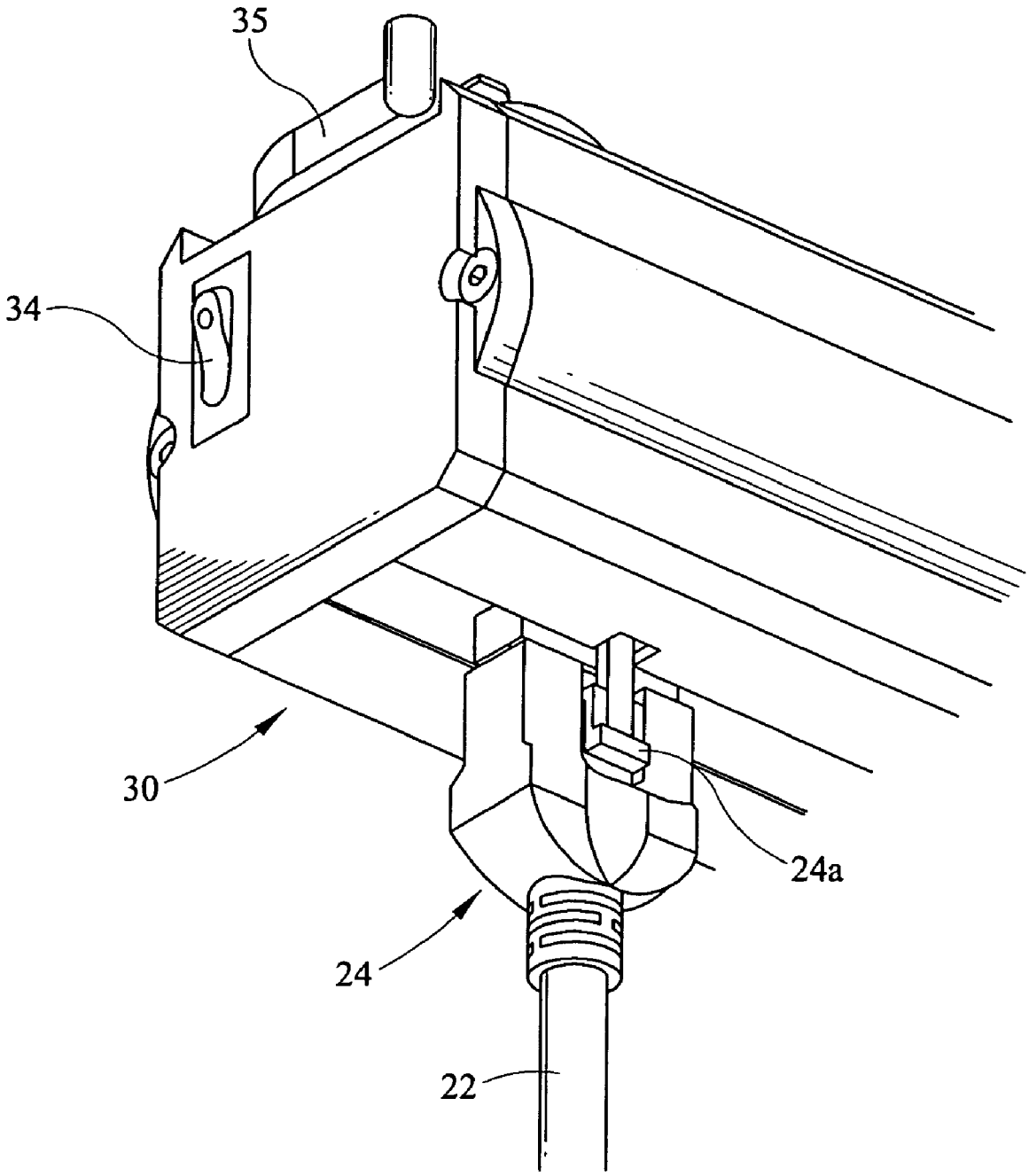
FIG. 7 is a view of the remote ballast unit electrically connected and receiving the cord and plug from the luminaire unit.

As can be seen from the embodiment depicted in FIG. 1, the luminaire unit 20 shown has a socket cup 18 having a lamp socket contained therein for retention of a lamp 27 shown in FIG. 5, the lamp 27 being any of a number of the varying high intensity discharge or other illumination sources. The luminaire unit 20 may be a number of different luminaire systems such as spot lighting, wall washing or other modular lighting units required for the particular environment to which the luminaire unit is being installed. The flexibility of the modular lighting system of the present invention is provided by the luminaire unit 20 incorporating into the design a cord and plug system, the cord 22 being in electrical communication with the lamp 27. The lamp 27 may be a number of different lamps available for use with similar high intensity discharge characteristics, such as T4 or T6. The lamps, commonly referred to as high intensity discharge, metal-halide or ceramic metal-halide lighting, typically offers significant performance enhancements over normal incandescent and fluorescent lighting sources. However, as is known, such high intensity lighting resources require different power supplies, therefore the need for the remote ballast housing utilized with the present invention.

Returning to the luminaire unit 20 of the present invention and depicted in FIG. 5, the luminaire unit 20 has, as mentioned, socket cup 18 which retains the mounting mechanism for lamp 27. Further, lens 25 may be utilized for covering of the illumination source, tinting or other desired illumination modification. Also, as is readily apparent from the depiction of the embodiment in FIG. 5, the luminaire unit 20 has a track attachment fitting 14 which is affixed to an attachment arm 15 for fixation of the luminaire unit 20 to a track. However, the track attachment fitting 14 as depicted is not required for electrical connection purposes and is provided to removably mount the luminaire to one of a number of mounting locations.

Figure 9A:
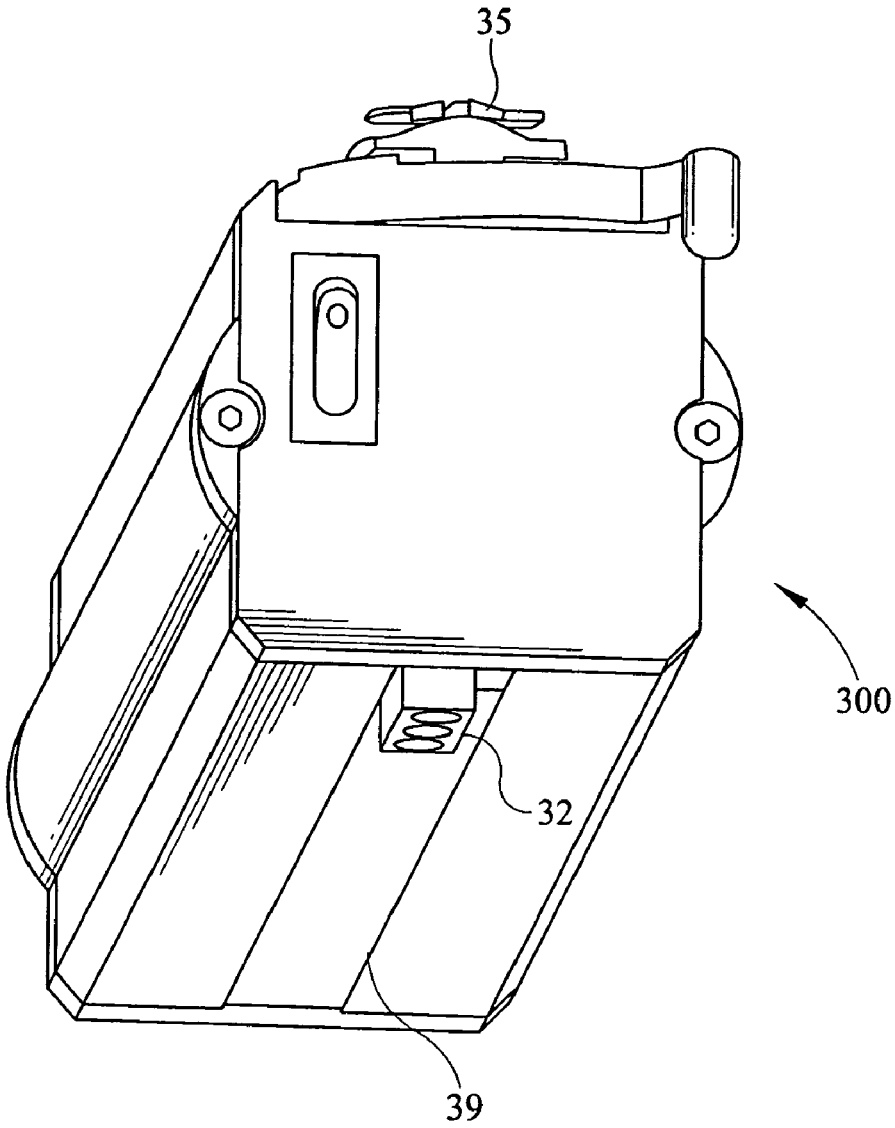
FIG. 9A is a separated view of the remote ballast housing and the mounting mechanism of the luminaire unit of the present invention.
Figure 9A:
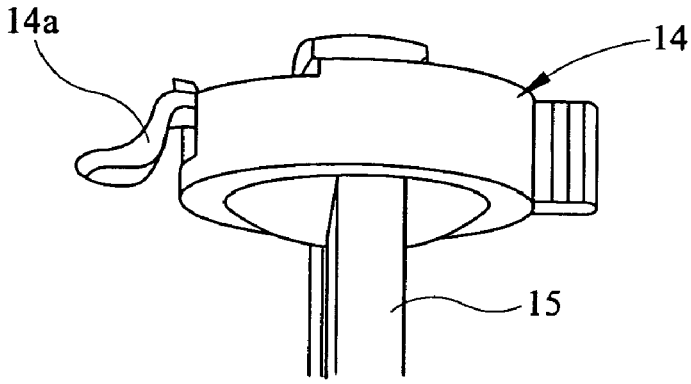
Figure 9B:
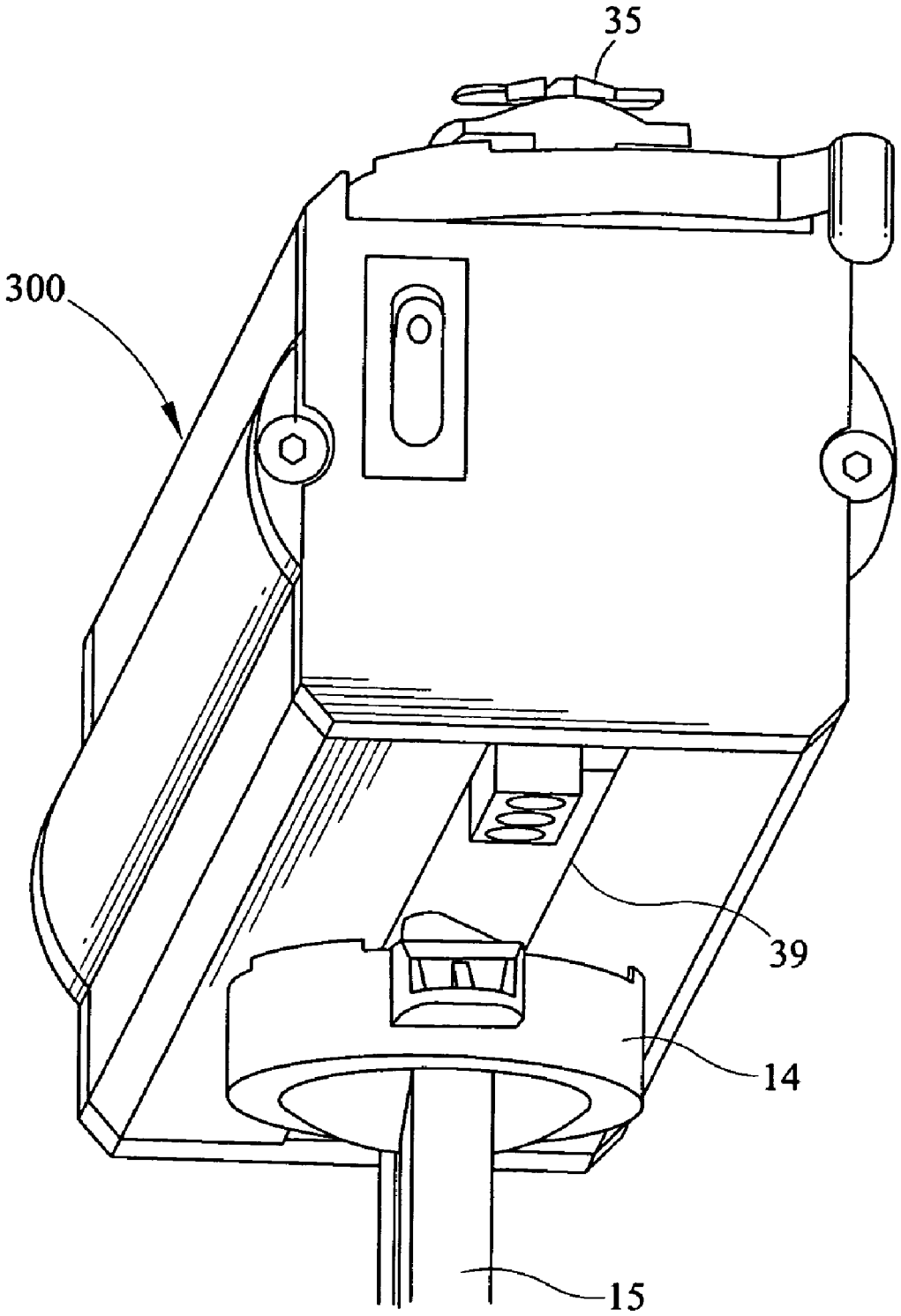
FIG. 9B is a connected view the luminaire unit mounting mechanism directly affixed to the track within the remote ballast unit.
Figure 13:
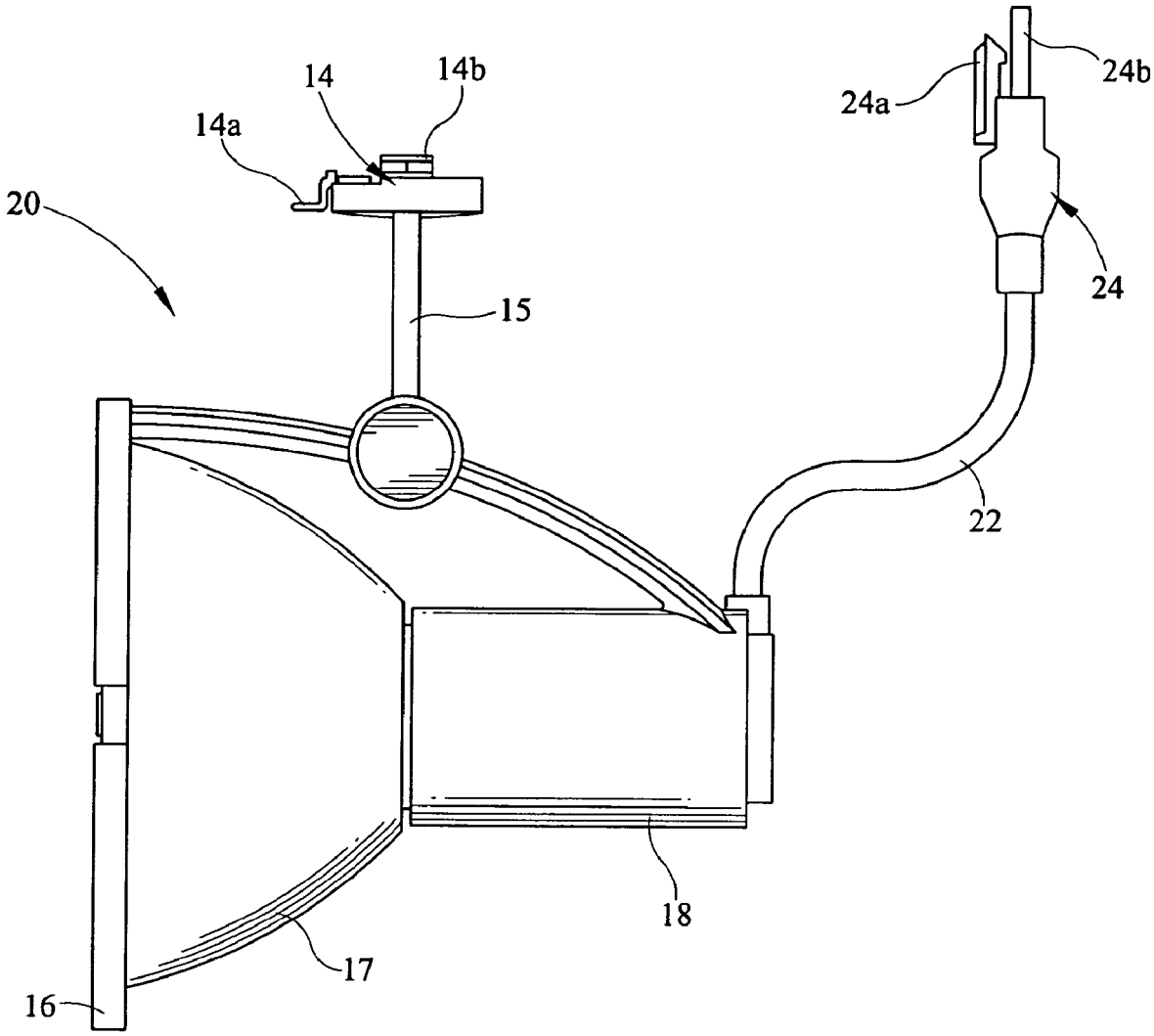
FIG. 13 is a side view of a luminaire unit of the present invention.

As is apparent from the construction of the track attachment fitting 14, shown in FIG. 13, as well as is shown in FIGS. 9A, 9B, 10A and 10*b*, the track attachment fitting 14 has an attachment arm 14*a* thereby allowing the attachment fitting 14 to be removably and non-electrically attached to a track, such as the track 39 shown in FIG. 9A. Thus, the luminaire unit 20 is attachable to the remote ballast housing track 39 through the use of the track attachment fitting 14, shown in FIGS. 9A and 9B, where it is shown as being removably affixed to the remote ballast housing track 39.

Figure 10A:
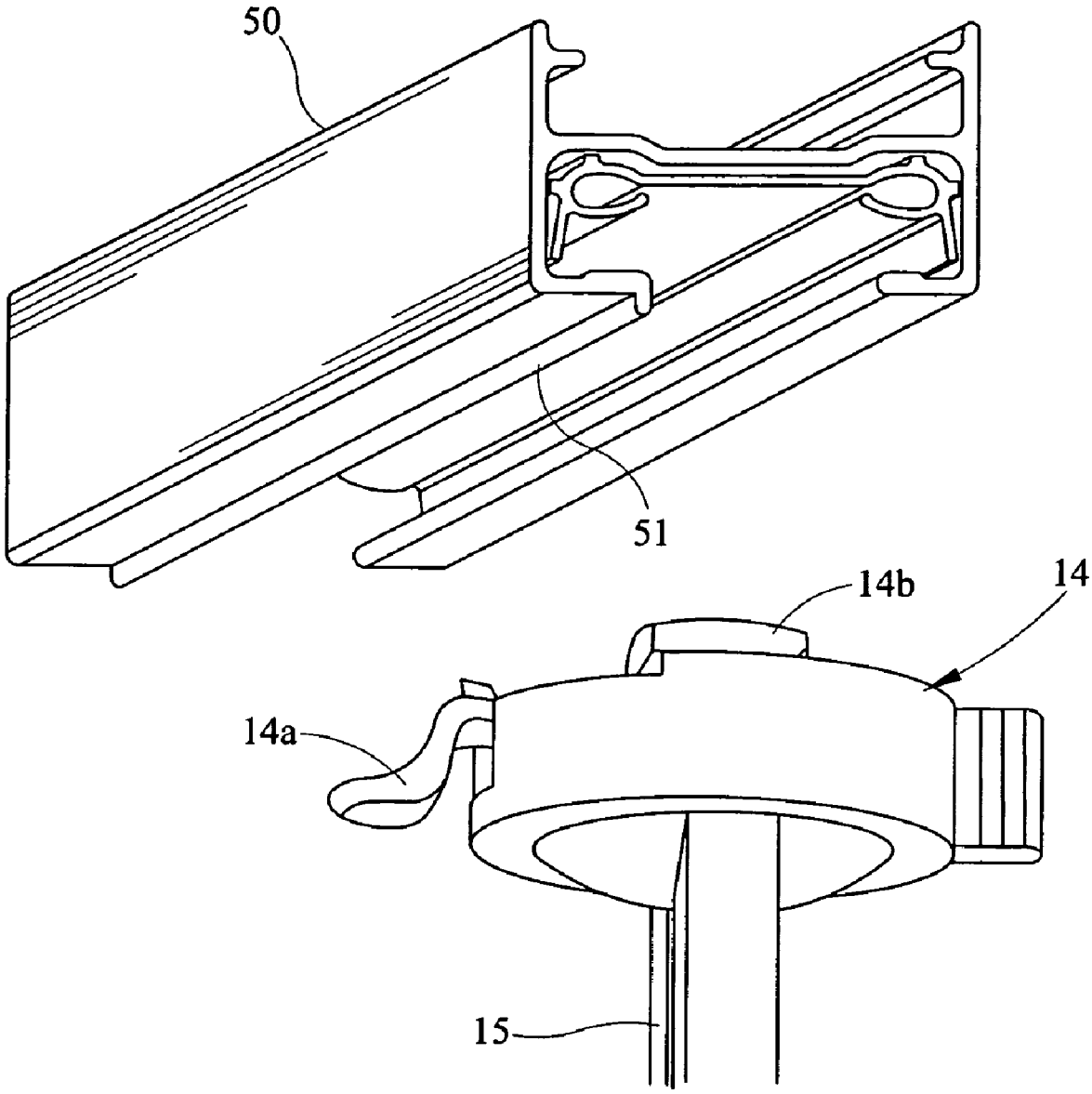
FIG. 10A is a close-up view of the luminaire unit mounting mechanism with a track lighting system of the present invention.
Figure 10B:
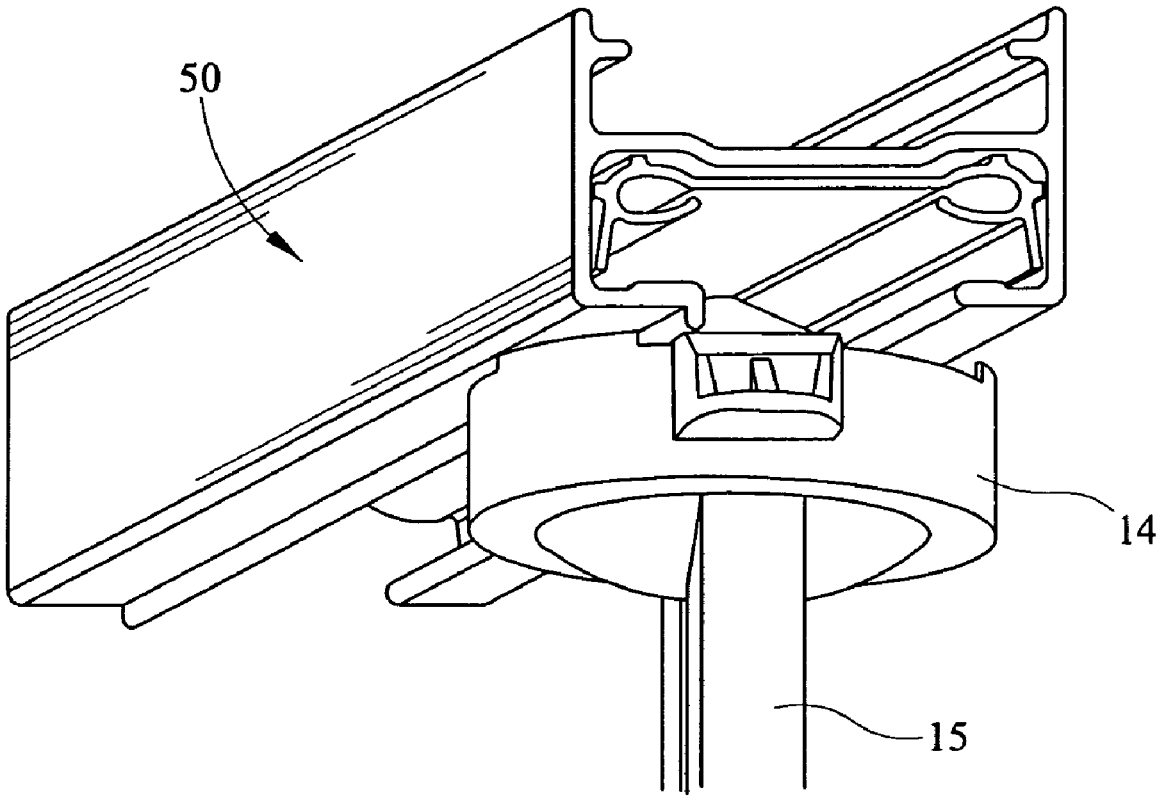
FIG. 10B is the connected track assembly fitting of the luminaire unit with the track lighting system.
Figure 11:
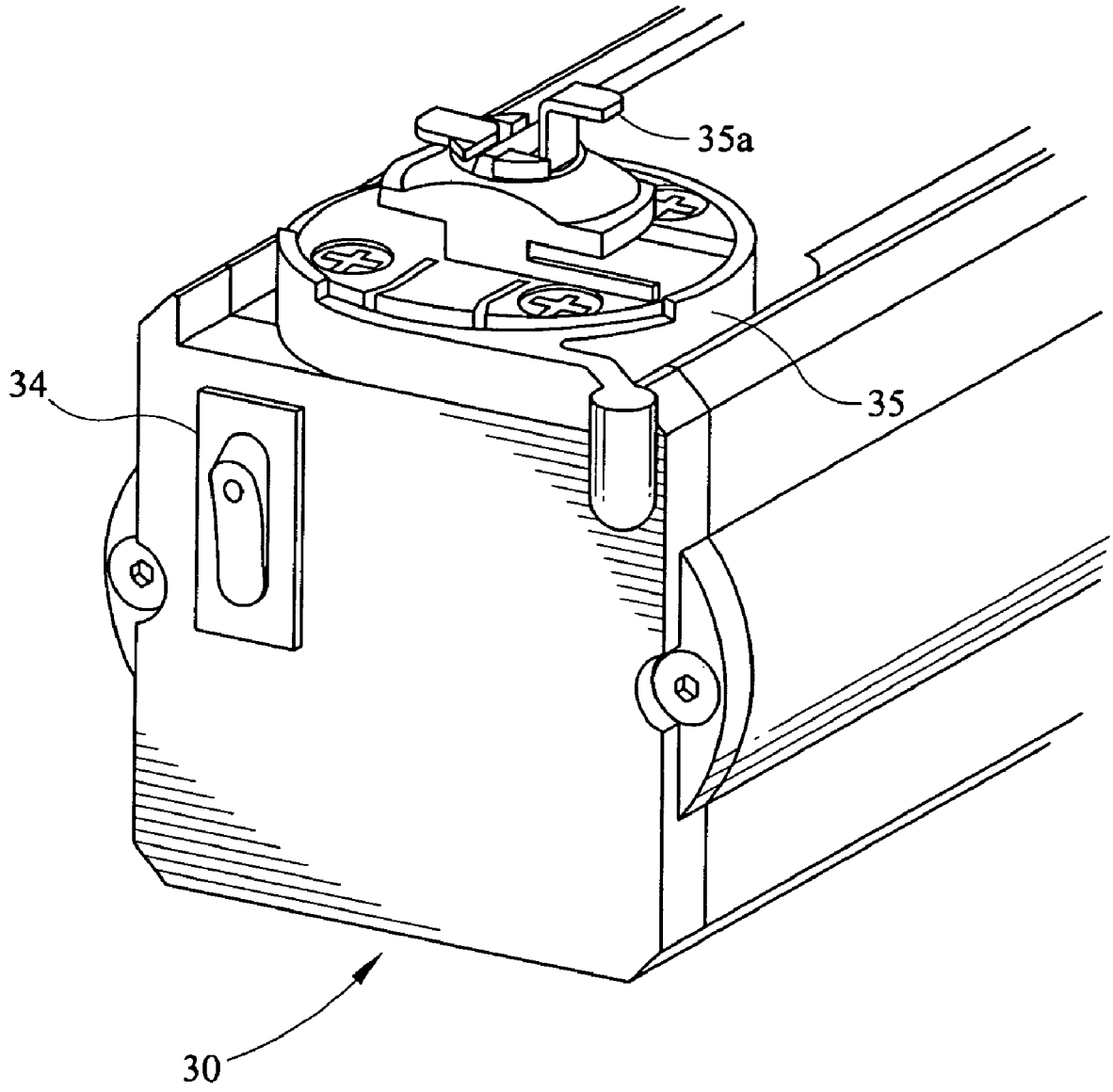
FIG. 11 is a close-up end view of the remote ballast unit of the present invention.

Alternatively, as is seen in FIGS. 10A and 10B, the luminaire unit 20 may be affixed to a track 50 having a track bead 51 as is shown, the track attachment fitting 14 having a locking lever 14*a* and support 14*b*. The track attachment fitting 14 may be a molded polycarbonate allowing for rotation of the lever and attachment mechanism into the track for removable attachment therein.

While it is shown that the luminaire unit 20 is affixed to a track unit, the modular luminaire system of the present invention is designed for a number of removable attachment mechanisms for each luminaire unit 20 and the examples shown herein are not to be considered to be limiting as they are exemplary only.

Returning to the example luminaire units shown in the figures, the luminaire unit 20 has incorporated an attachment arm 15 which extends upward to a track attachment fitting 14. The track attachment fitting 14 is a standard track attachment unit as is shown much more closely in FIGS. 9A, 9B, 10A and 10B. The track attachment fitting has a lever 14*a* for rotation of slide or attachment mechanism 14*b*. The attachment arm 15 and track attachment fitting 14 allows for the luminaire unit 20 to be directly affixed to a track 30. The track may be a track directly formed in a remote ballast housing unit, such as is shown in FIG. 1. Of course, the track attachment fitting 14, shown in the examples, allows for the luminaire unit 20 to be directly affixed to a track located on either a remote ballast housing, external track assembly or other peripheral device. Of note, however, is that luminaire unit 20 of the present invention is not utilizing the track attachment fitting 14 for electrical connection but is merely using it as a releasable mounting mechanism for releasably affixing the luminaire unit to the appropriate overhead assembly. Thus, the specific mounting arrangement shown in the drawings is not considered limiting.

Returning to the examples shown in the Figures, the luminaire unit 20 additionally has the lens 25, lamp 27 and luminaire face 16, all of which may be modified according to user preference and design necessities. A significant number of variations are allowable for design of the particularized luminaire unit 20 used. The particular constructions shown are exemplary only.

Cord and Plug Assembly

The luminaire unit 20 also has shown extending outward from the socket cup 18 a cord and plug assembly which is comprised of the cord 22 and attachment plug 24. Interior of the cord 22 are conductors which are three each individually wrapped in adequate insulation, the entirety of the three insulated conductors then enclosed in additional silicone insulation material. As is known, the conductors include one ground and two live conductors for completion of the appropriate circuit. Each of the conductors terminate at the insulated conductors ends 24*b*. As can be seen, the conductive ends 24*b* extend outward from the plug 24 and are utilized to electrically connect the luminaire unit 20 with pins in plug receptacle 32 and the electronics within the remote ballast housing 30.

Figure 16:
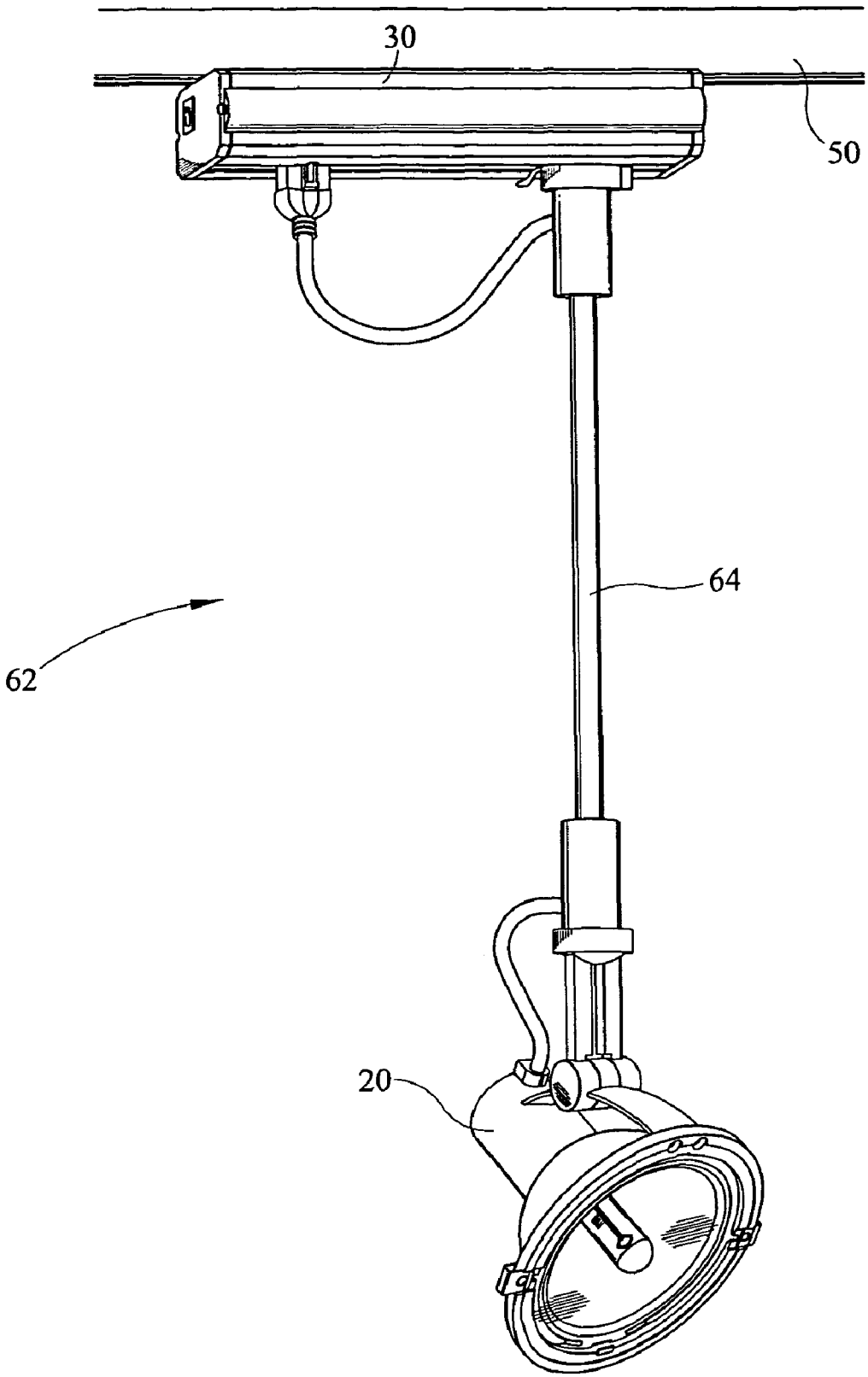
FIG. 16 is a side view of an exemplary modular lighting system embodiment of the present invention; and, FIG. 17 is a close-up side view of an alternative embodiment mounting for the luminaire unit of the present invention.
Figure 17:
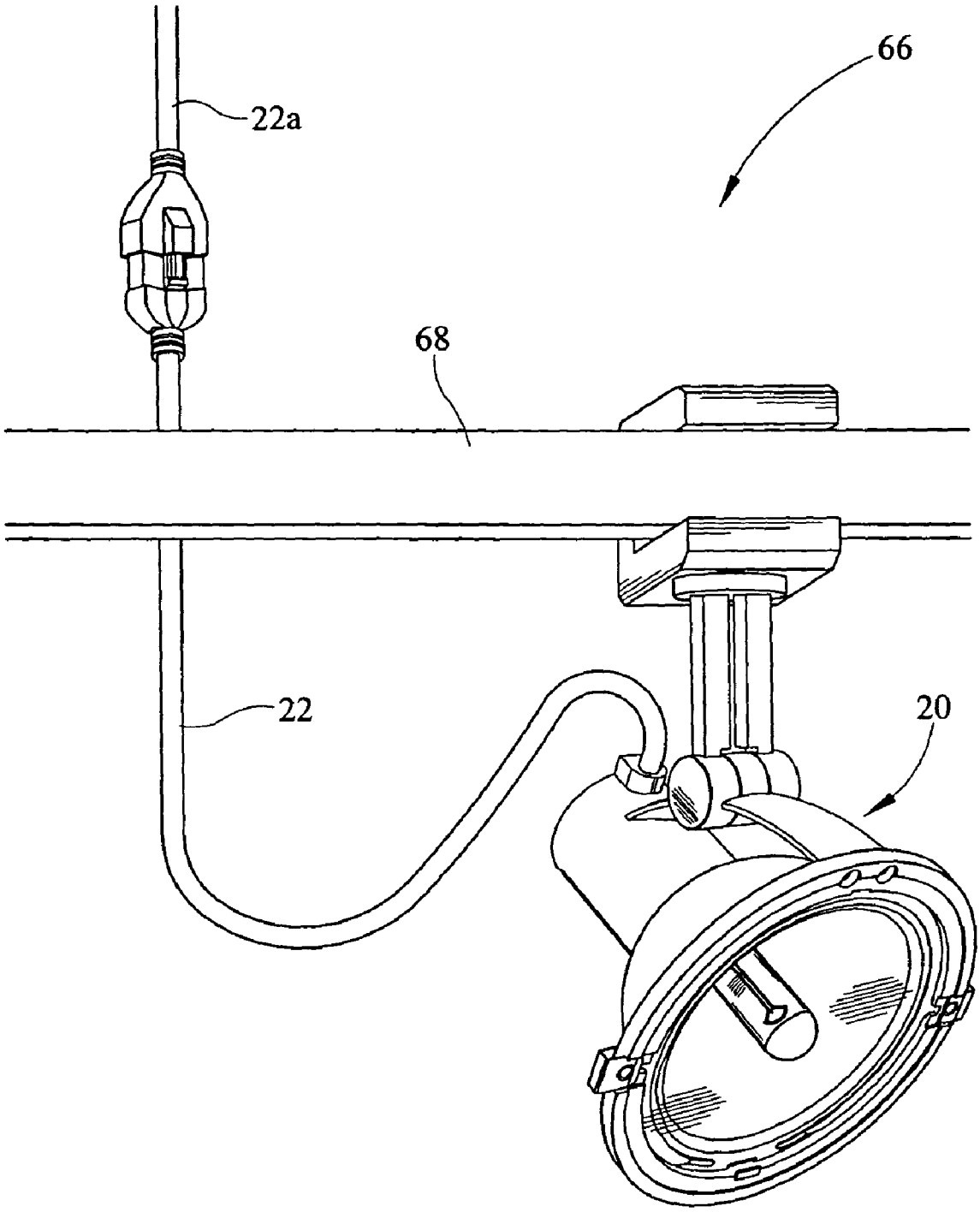

The three conductor system utilized allows for the luminaire unit 20 to be removably and electrically connected to the remote ballast housing 30, regardless of the location of the remote ballast housing 30 or the mounting of the luminaire unit 20. However, due to the necessary starting pulse for activation of the high intensity discharge lamps, the cord 22 and plug 24 must necessarily be properly insulated to withstand and adequately insulate up to a 5 KV starting pulse or more. This starting pulse may be as low as 4 KV dependent upon the particular electronics or lamps utilized. However, the cord and plug as well as the insulated conductors 24*b* are adequately insulated to prevent electrical shock and meeting all necessary standards for insulation. Also of note is that the plug 24 may incorporate a locking lever 24*a* to maintain the plug in position within the plug receptacle 32 of the remote ballast housing 30. The locking tab merely positions into a slot adjacent to the plug receptacle 32 and prevents the plug from being removed from the remote ballast 30 without depression of the locking tab 24*a*. Thus, the design of the modular illumination system of the present invention allows for the electrical connection of the luminaire unit 20 through the use of the cord and plug system described independent of the actual luminaire unit and the remote ballast housing. Further, because of the design, the luminaire unit 20 may be significantly separated from the remote ballast housing 30 wherein an insulated extension cord, such as is shown in FIGS. 16 and 17 may be utilized to electrically connect the luminaire unit 20 to the remote ballast housing 30 even when there is considerable distance between the two. Also of note is that the mounting mechanism utilized for the luminaire unit 20 may vary such that the user may decide where or in what environment the luminaire unit 20 of the present invention may be utilized as long as the luminaire unit 20 is combined with an adequate remote ballast housing 30 necessary for supplying adequate power to the lamp.

Remote Ballast Housing

Figure 4:
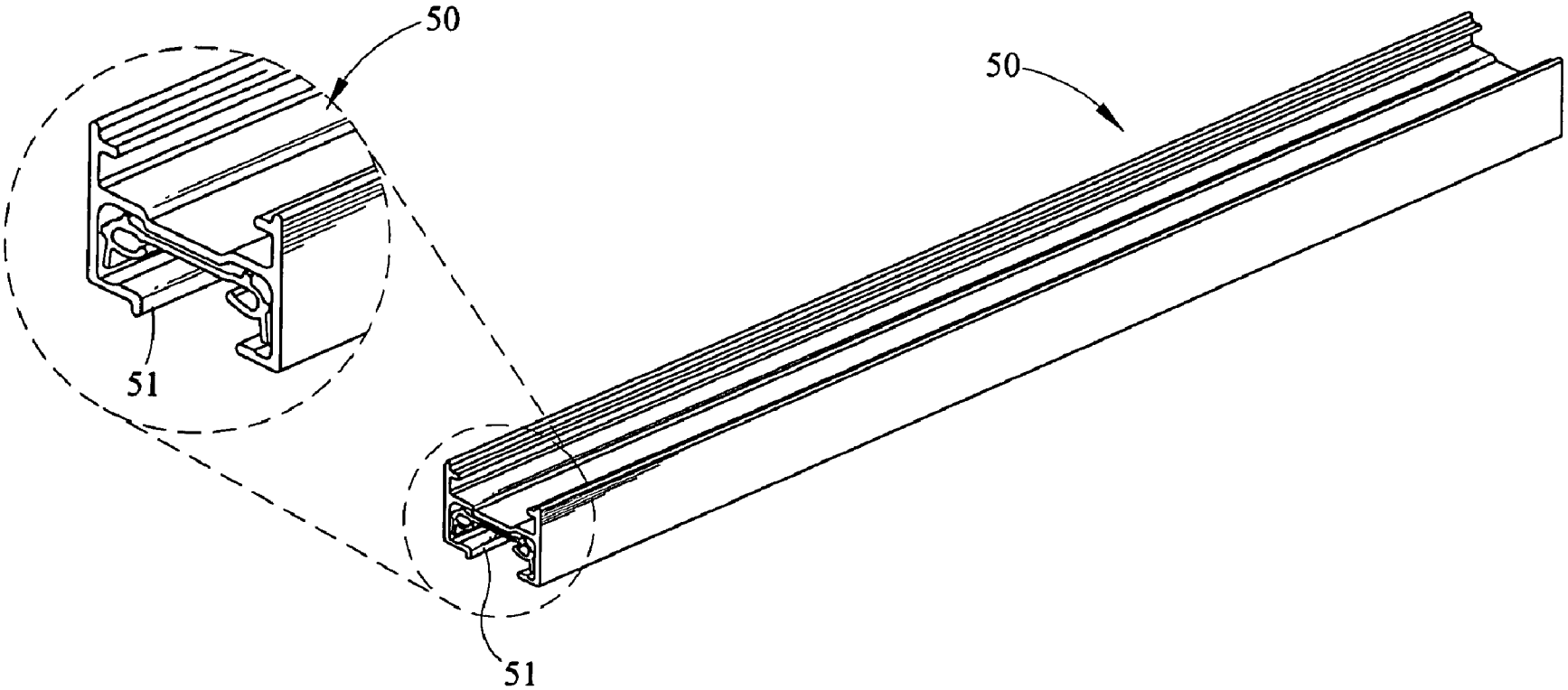
FIG. 4 is a perspective and close-up view of the track lighting system for use with the remote ballast unit of the present invention.

The remote ballast housing utilized in the present invention may be one of a number of designs and may incorporate either an electronic ballast or a magnetic ballast. The remote ballast housing depicted in the drawing is electrically connected to the luminaire unit 20 and may itself be electrically connected to a live track assembly 50, such as is shown in FIG. 4, or may be electrically connected to a junction box as in a canopy mount, shown in FIG. 14. The ballast may be 39 Watts or 100 Watts depending upon the necessary lamp or illumination electronics utilized. Thus, the power provided by each of the various remote ballast housings 30 may be modified depending upon the particular usage and connected luminaire unit.

Figure 8A:
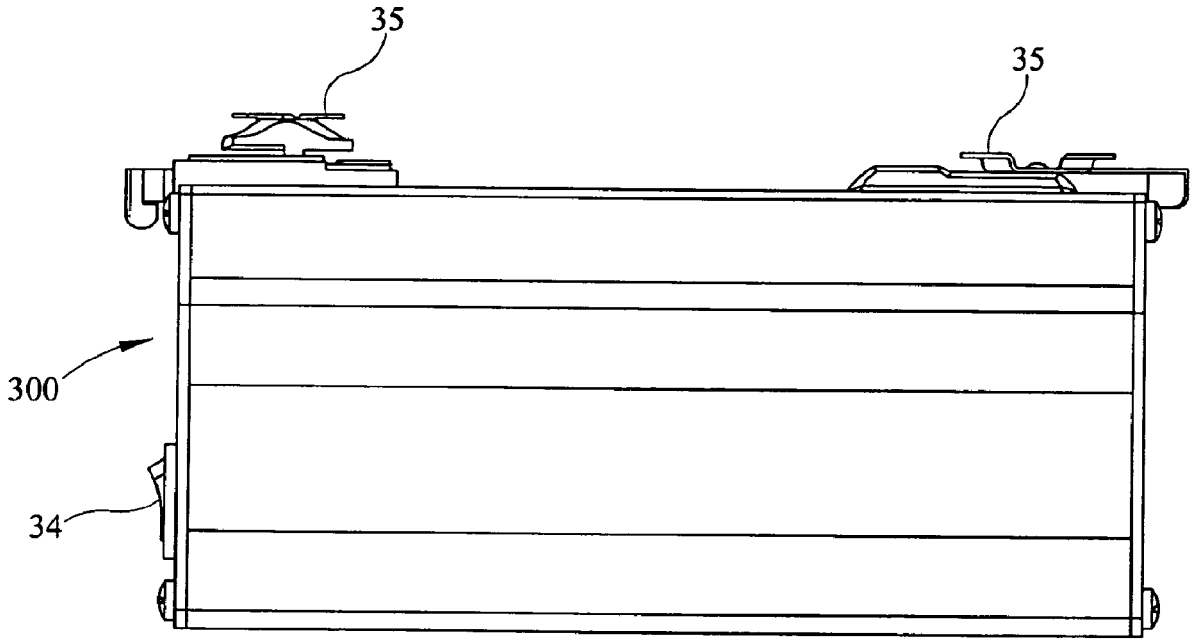
FIG. 8A is a side view of an alternative remote ballast housing of the present invention.
Figure 8B:
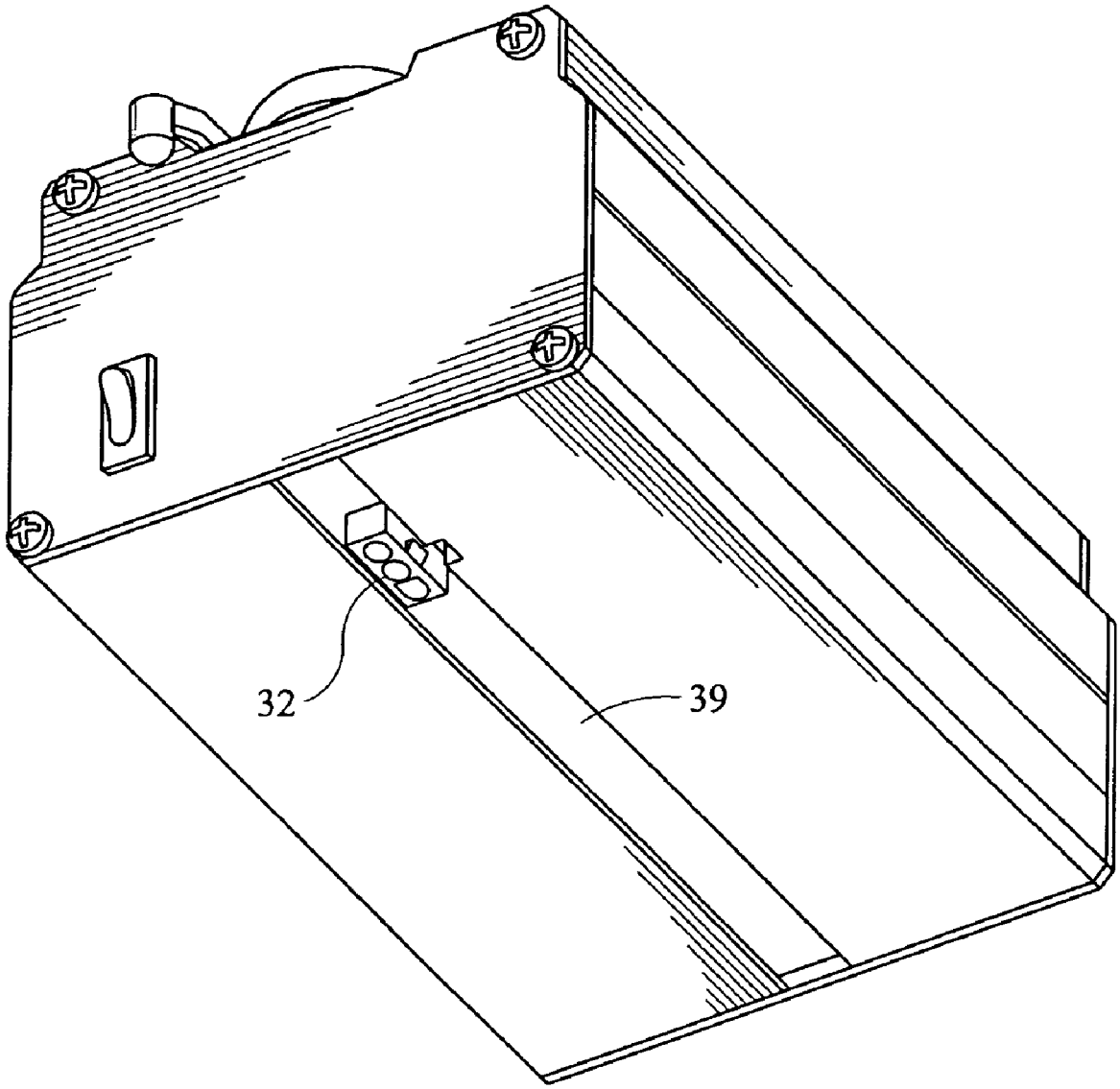
FIG. 8B is a bottom perspective view of the remote ballast housing of FIG. 8A.
Figure 12:
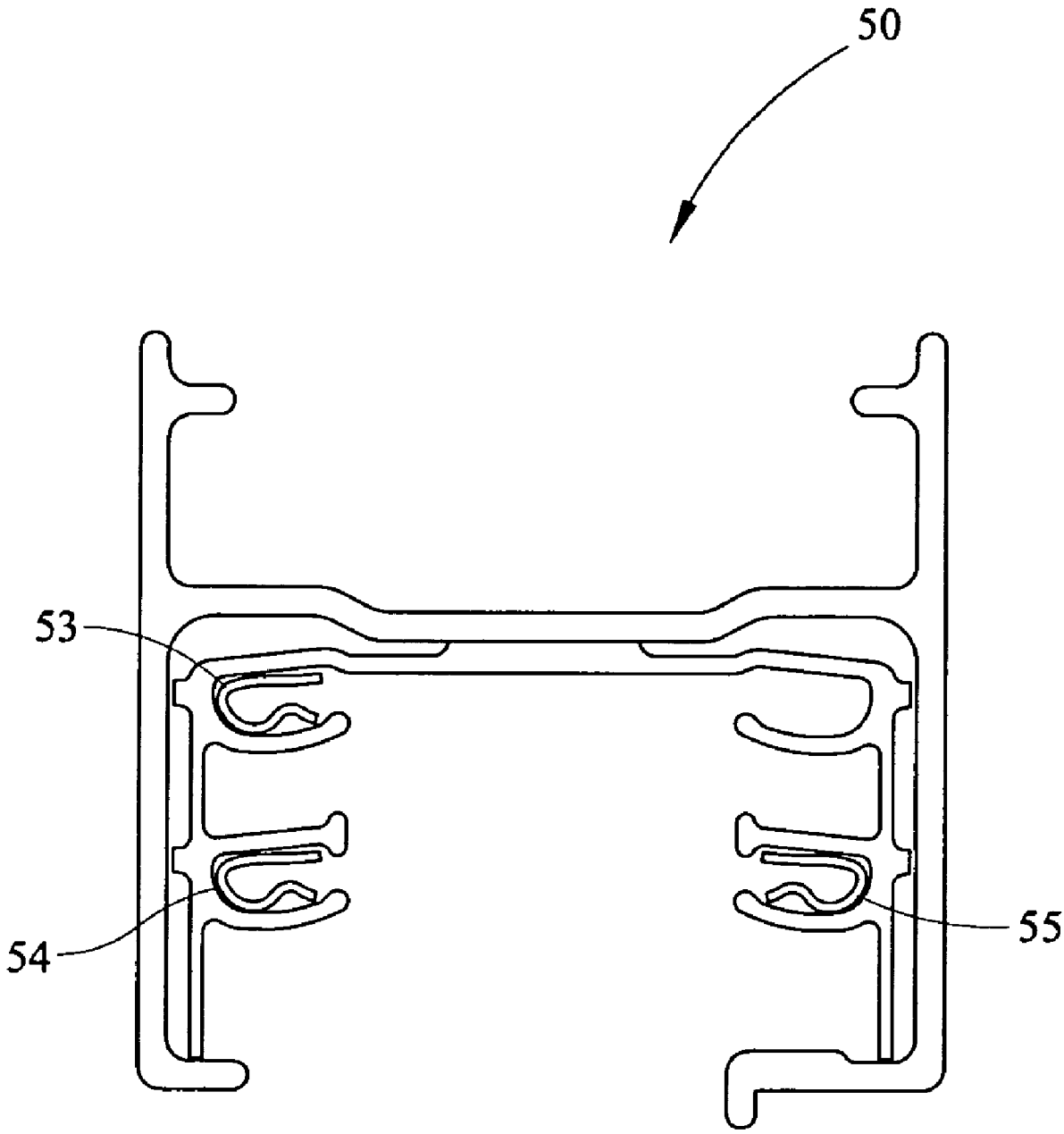
FIG. 12 is a side sectional view of the track system in use with the present invention.
Figure 14:
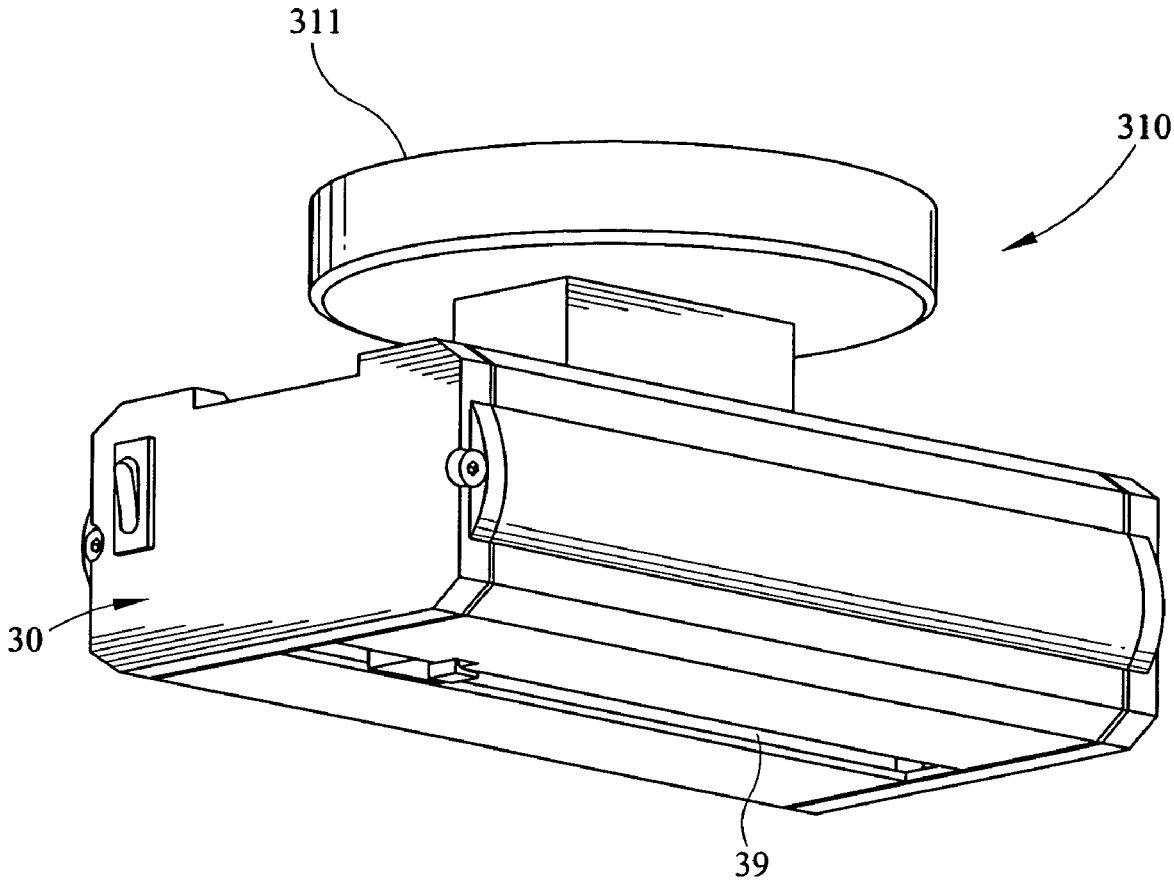
FIG. 14 is a lower perspective view of a remote ballast housing having a canopy attachment of the present invention.

The remote ballast housing 30 shown in the Figures incorporate various connection mechanisms such as the track attachment fittings 35, shown in FIG. 8A, for the larger magnetic remote ballast housing 300, and as previously indicated, may incorporate a plug receptacle 32 on the bottom end thereof. The plug receptacle 32 may have three conduits or electrical contact pins for contacting the insulated conductor ends 24*b* of the plug 24. The remote ballast housing 30, 300, or 310 shown in FIG. 14, may also have on the lower surface thereof a ballast housing mounting 39 which allows for removably and non-electrically mounting the luminaire unit 20. Thus, the luminaire unit 20 may be directly and non-electrically connected to the remote ballast housing through the track so that it is kept in somewhat close proximity to the remote ballast housing. Alternatively, the luminaire unit 20 may be mounted remotely therefrom. As is also shown in the Figures, the remote ballast housing embodiments depicted also incorporate a power switch 34 for turning on and off the power provided by the remote ballast housing. This may be necessary for connecting of the power cord 22 after the remote ballast housing has been electrically connected to a power source. The power source may be a live track assembly 50, as is shown in FIG. 4 and FIG. 12, or may be a junction box by a canopy mount 311, as shown in FIG. 14. As is known in the art and as shown in the figures, the track attachment fittings 35 for the remote ballast housing may include the necessary metalized contacts 35*a* to appropriately contact the active tracks of the track assembly 50, shown in FIG. 12 as being upper circuit 53, lower circuit 54 and neutral track 55.

Thus, the remote ballast housing depicted in the Figures may be electrically connected to the track 50 or to an alternative electrical source.

EXAMPLES

As is readily apparent, the ability of modularizing the luminaire units and the ballast electronics as is done in the present invention is through the use of a plug and cord assembly allows for significant variations in design and use of high intensity lamp illumination. Of the examples shown in FIGS. 15, 16 and 17, as well as throughout the rest of the Figures, it is apparent that the luminaire unit 20 may be remotely positioned away from the remote ballast housing and mounted on a number of mounting surfaces.

Figure 15:
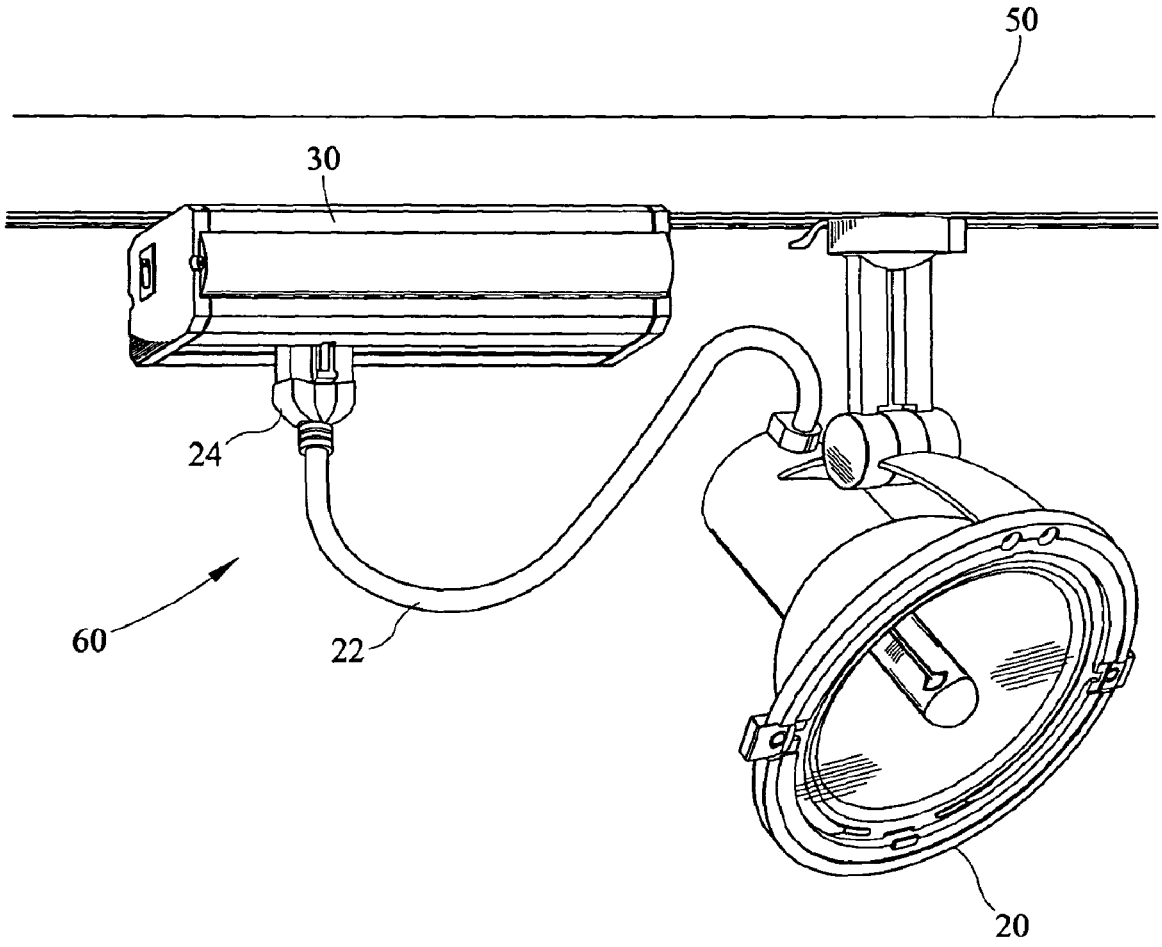
FIG. 15 is a perspective view of an exemplary modular lighting system of the present invention.

As is shown in FIG. 15, the luminaire unit 20 is mounted directly to a track 50, but is not electrically connected thereto. The luminaire unit 20 is electrically connected through the cord 22 and plug 24 to the remote ballast housing 30 which is electrically connected to the energized track 50. The modular HID luminaire unit 60, shown in FIG. 15, therefore depicts the luminaire unit adjacent to and electrically connected to the remote ballast housing but not mounted or affixed thereto.

Alternatively, as is shown in FIG. 16, the modular HID luminaire unit 62 depicted therein incorporates the use of a remote ballast housing 30 affixed to a track 50 and, dependent from the ballast housing track 39, is an extension wand 64 for remote placement of the luminaire unit 20. An electrical cord extends from the luminaire unit 20 to the remote ballast housing and the luminaire unit 20, by virtue of the extension wand 64 and is directly mechanically affixed to the remote ballast housing but is removably attached therefrom for alternative placement. Additionally, as is apparent from both FIGS. 16 and 17, the cord 22 may incorporate a remote extension cord 22*a*, as shown in FIG. 17 for extending the distance between the luminaire unit 20 and the remote ballast housing. Also, as shown in FIG. 17, the luminaire unit 20 is remotely mounted from the remote ballast housing and, as is shown in this example, the modular luminaire unit 66 is removably mechanically attached to a mounting bar 68 completely separate from the remote ballast housing.

As is readily apparent, a number of variations due to modularity of the modular HID luminaire unit system of the present invention allows for a number of various mechanical attachments between the luminaire unit and the remote ballast housing. The luminaire unit may be directly attached to the remote ballast housing through the use of a remote ballast housing track mounting system or may be mounted separate therefrom. Also, as is readily apparent, the luminaire unit 20 is readily and easily removably attached to any position and is also removably electrically connected to the remote ballast housing. Thus, the luminaire unit 20 may be matched to an appropriate remote ballast housing depending upon the electrical needs of the illumination system and the particularized ballast utilized.

The invention claimed is:

1. A modular track lighting system having a remote canopy ballast and a modular luminaire unit, comprising:

a track lighting type luminaire unit having an insulated power cord plug system, a non-electrically conductive mechanical track attachment fitting and a light source;

a remote canopy ballast housing having an electrical connection, said remote ballast housing having a plug receptacle electrically connected to said electrical connection, said plug receptacle removably receiving said plug of said luminaire unit;

said remote canopy ballast housing further having a non-electrical mounting track on an external surface for removably receiving said non-electrically conductive mechanical track attachment fitting of said track lighting type luminaire, said luminaire unit repositionable in a plurality of locations along said non-electrical mounting track.

2. The system of claim 1 wherein said track lighting type luminaire unit has a standard electrical track lighting attachment mechanism in combination with said insulated power cord plug system.

3. A modular track lighting system having a remote canopy ballast and modular luminaire unit, comprising:

a luminaire unit having an housing and a lamp socket;

a remote canopy ballast housing separate from said luminaire unit;

a flexible cord and plug system including a cord attached to said luminaire unit and removably electrically connectable to said remote canopy ballast housing;

said remote canopy ballast housing having a plug receptacle for receiving said cord;

said cord having a plug, said plug received in said plug receptacle of said remote canopy ballast housing;

said remote canopy ballast housing having a canopy mount designed to mount to a junction box and to electrically connect said remote canopy ballast housing to a power supply; and, said remote canopy ballast housing having an integral track groove extending along an exterior surface, said luminaire unit repositionable in a plurality of locations along said integral track groove.

4. The modular track lighting system of claim 3, said luminaire unit having a track attachment fitting for non-electrical mounting of said luminaire unit.

5. The modular track lighting system of claim 4 wherein said track attachment fitting of said luminaire unit is removably received in an integral track groove of said remote ballast housing.

6. The modular track lighting system of claim 3 wherein said remote canopy ballast housing has an electrical power switch to interrupt said electrical connection between said remote canopy ballast housing and said luminaire unit.

7. A modular track lighting system having a remote canopy ballast and modular luminaire unit, comprising:

a luminaire unit having a lamp socket, a flexible insulated power cord and a power cord plug and a removable mounting mechanism;

a remote canopy ballast unit having a power supply, an electrical plug receptacle and a canopy mount for mounting to a junction box;

said power cord plug removably received in said plug receptacle of said remote canopy ballast unit to electrically connect said lamp socket to said power supply;

wherein said remote canopy ballast unit is affixable to a junction box;

and wherein said luminaire unit is removably and non-electrically mounted to said remote canopy ballast unit in a plurality of positions along an integral track formed on an exterior surface in said remote ballast unit.

* * * * *